United States Patent [19]

Benseler et al.

[11] 4,141,158

[45] Feb. 27, 1979

[54] FOOTWEAR OUTER SOLE

[75] Inventors: Hans Benseler, Harkenbleck-Hannover; Horst Schaefer, Bad Windsheim, both of Fed. Rep. of Germany

[73] Assignee: Firma PUMA-Sportschuhfabriken Rudolf Dassler KG, Fed. Rep. of Germany

[21] Appl. No.: 782,376

[22] Filed: Mar. 29, 1977

[30] Foreign Application Priority Data

Mar. 29, 1976 [DE] Fed. Rep. of Germany ..... 2613312

[51] Int. Cl.[2] ..... A43B 13/04; A43C 15/00

[52] U.S. Cl. ..... 36/32 R; 36/59 C; D2/320

[58] Field of Search ..... 36/32 R, 59 C, 59 R, 36/114, 128, 129; D2/319–322

[56] References Cited

U.S. PATENT DOCUMENTS

| | | | |
|---|---|---|---|
| D. 157,989 | 4/1950 | Lussier | D2/320 |
| 3,629,051 | 12/1971 | Mitchell | 36/32 R X |

FOREIGN PATENT DOCUMENTS

| | | | |
|---|---|---|---|
| 176153 | 9/1953 | Austria | 36/59 C |
| 249549 | 9/1966 | Austria | 36/59 C |
| 962584 | 4/1957 | Fed. Rep. of Germany | 36/59 C |
| 1093702 | 11/1960 | Fed. Rep. of Germany | 36/59 C |
| 2525613 | 12/1976 | Fed. Rep. of Germany | 36/32 R |
| 2525615 | 12/1976 | Fed. Rep. of Germany | 36/32 R |
| 2525665 | 12/1976 | Fed. Rep. of Germany | 36/32 R |
| 1434840 | 2/1966 | France | 36/59 C |
| 1502112 | 10/1967 | France | 36/32 R |
| 1258047 | 12/1971 | United Kingdom | 36/32 R |
| 1297987 | 11/1972 | United Kingdom | 36/32 R |

*Primary Examiner*—James Kee Chi

*Attorney, Agent, or Firm*—Craig & Antonelli

[57] ABSTRACT

A profiled outer sole for shoes made of a material having rubber-elastic properties with the sole including a tread surface having a front tread end portion, rear tread end portion, a profiled middle area and profiled marginal areas arranged on respective sides of the middle area. The front tread end portion, the rear tread end portion and each of the marginal areas include outer edges adjoining the tread surface to a shell rim of the outer sole with each of the outer edges being rounded with a predetermined radius. The marginal areas define foundation strips having spaced block-shaped profiled projections enclosing box-shaped profiled projections with a number of groove-shaped slots being substantially uniformly distributed along each of the foundation strips.

67 Claims, 1 Drawing Figure

FOOTWEAR OUTER SOLE

Figure 1:
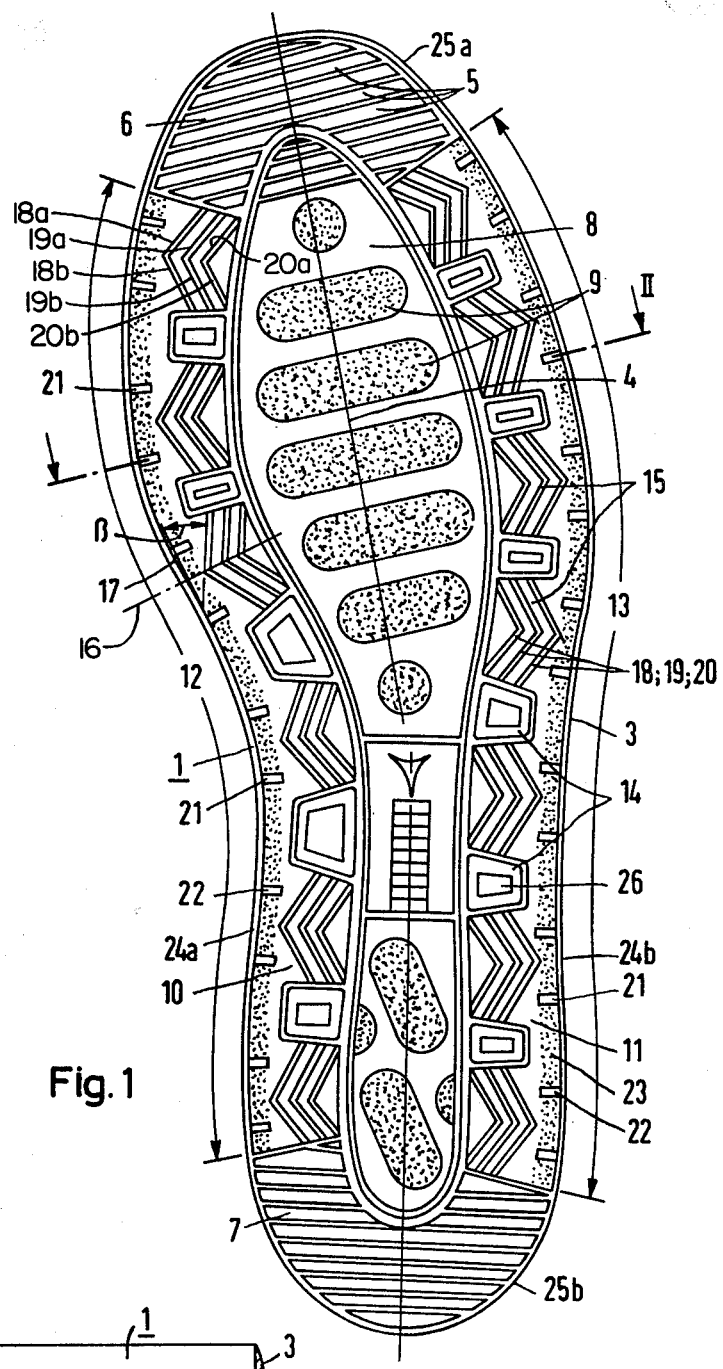

The present invention relates to a profiled outer sole for a shoe produced in a mold, especially sport shoes of rubber or another material having rubber-elastic properties, especially a synthetic resinous material.

It is known in connection with sport shoes to provide a tread with profiles to improve their non-slip property in the open country and/or on planar, more-or-less smooth floors, especially on gymnasium floors or the like.

Also, there are so-called all-purpose sport shoes which can be utilized by a person pursuing athletics as a hobby for almost all types of sports. However, in addition to such all-purpose shoes, specialized sport shoes are known which are preferred, for example, by boxers, light or heavy athletes, tennis players, volley ball players, wrestlers, etc. In all of these specialized sport shoes normally used by sportsmen or athletes, the important feature, in particular, is the more-or-less finely detailed profiling of the tread and the thus-attained non-slip property of the tread on a flat surface.

With almost all types of indoor sports pursued by high-performance athletes, the footwear utilized must meet very diversified requirements. Thus, for example, if the requirements are a secure tread, a lateral non-slip feature, elasticity, and the like, the requirement for shoes used by athletes who prance or shuffle about in one location for a relatively long period of time such as, for example, boxers or basketball players, are different from the requirements for shoes used by athletes who, in a competitive game must, for example, render top performances and maintain maximum contact with the playing surface or floor frequently while in a falling and/or almost horizontal position with the shoes in an extremely oblique disposition relative to the playing surface as is the case with, for example, volley ball players, indoor handball players, goalkeepers, wrestlers, or the like.

The aim underlying the present invention essentially resides in providing a shoe, especially a sport shoe having a tread surface which affords maximum contact with the ground, floor or other playing surface in a normal foot position of the user or normal position of the sole, as well as in an extremely oblique foot position with respect to the floor or inclined position of the shoe sole.

For this purpose, provision is made in accordance with the present invention that the sole of the shoe includes a tread having a front tread end portion and a rear tread end portion of fine profiling, a middle zone having nub-like profiled projections or raised portions arranged approximately symmetrically with respect to a longitudinal axis of the tread, and two marginal or lateral edges of a coarse profiling disposed on respective sides of the middle zone.

According to one feature of the present invention, the front and rear tread end portions and each of the marginal or lateral zones include outer rims or edges which are rounded with a radius. By virtue of this feature, the tread of a sport shoe can be displaced from its normal position on the ground, gymnasium floor or other playing surface by a rolling motion by way of the marginal edges of the sole, as well as by way of the front and/or rear ends of the tread into an inclined position and can be maintained during such motion in maximum contact with the floor.

According to a further advantageous feature of the present invention, groove-shaped slots or notches are uniformly distributed along the marginal edges to effect a claw-type action so as to increase the traction of the tread.

According to a still further feature of the present invention, overlapped projections or raised portions are provided in the middle tread zone to ensure an especially elastic soft step for the shoe.

Accordingly, it is an object of the present invention to provide a shoe having a tread thereon which avoids the drawbacks and shortcomings encountered in the prior art.

Another object of the present invention resides in providing a shoe having a tread especially suited for all types of sports, especially all types of indoor sports, which permit the wearer even with an extremely inclined position of the shoe to maintain a maximum contact with the ground, floor or other playing surface.

A further object of the present invention resides in providing a shoe having a tread which is capable of travelling in a rolling motion by way of marginal edges thereof and which effects a claw-type action at the outer rims of the tread.

Yet another object of the present invention resides in providing a shoe having a tread, the rim foundations of which are configured such that, even in case of a most extreme oblique position of the wearer such as, for example, in flying throws which occur in European indoor handball, a ground contact is maintained which has not been possible with conventional shoes.

Figure 2:
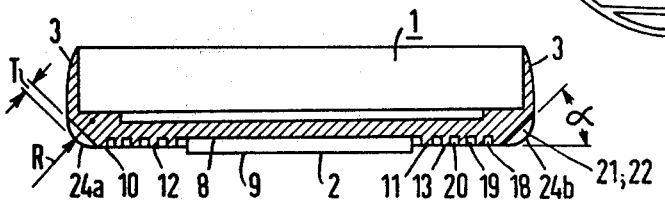

These and other objects, features and advantages will become more apparent from the following description when taken in connection with the accompanying drawings which show, for the purposes of illustration only, one embodiment in accordance with the present invention and wherein:

FIG. 1 is a plan view of an outer sole for a sport shoe, especially suited for indoor sports, in accordance with the present invention, and FIG. 2 is a cross-sectional view taken along the line II—II in FIG. 1.

Referring now to the drawings wherein like reference numerals are used in both views to designate like parts, according to FIGS. 1 and 2, the sole body made in one piece and preferably constructed as shell-shaped consists of a material with rubber-elastic properties, such as natural or synthetic rubber, synthetic resinous material made rubber-elastic by the addition of suitable hardeners or curing agents, preferably on the basis of polyurethane, epoxy resins, or the like. The tread 1 has a tread surface 2 and a shell rim 3 extending approximately at right angles to the tread surface 2 which is composed of a front tread end 6 provided with a fine profiling, a rear tread end 7 provided with a fine profiling, a middle tread zone 8 having nub-shaped profiled projections and raised portions 9 arranged approximately symmetrically to a longitudinal axis 4 of the tread, and two marginal zones or areas 10, 11, each of which are provided with a coarse profiling with the front and rear tread ends 6, 7 and the marginal zones 10, 11 defining the middle tread zone or area 8, The front and rear tread ends 6, 7 each include an outer sole edge or rim 25*a*, 25*b*, respectively, and a plurality of ribs extending vertically outwardly from the tread surface outer sole and are arranged substantially at a right angle with respect to the longitudinal axis 4 of the tread. The ribs define cross webs 5 which have an approximately trapezoidal cross-sectional configuration.

The coarse profiling provided along the two marginal zones 10, 11 of the tread 1 forms two foundation strips 12, 13 which extend between the tread ends 6, 7. The foundation strips 12, 13 may be continuous or formed by a plurality of individual foundation strips. The foundation strips 12, 13 each include outer edges or rims **24*a*, 24*b*, respectively, with the edges 24*a*, 24*b* of the two foundation strips 12, 13 and the outer edges 25*a*, 25*b* of the two tread ends 6, 7 being rounded toward the shell rim 3 of the tread 1 with a radius R as shown most clearly in FIG. 2**. The radius R has a dimension of about 3–8 mm and is preferably equal to 5 mm.

The foundation strips 12, 13 are each composed of a plurality, preferably, five to 10 block-shaped profiled projections or raised portions 15 which respectively enclose box-shaped profiled projections or raised portions 14 or are separated from one another by the projections or raised portions 14. The spaced block-shaped projections 15 and box-shaped profiled projections 14 form respectively individual foundation strips along each marginal zone 10, 11.

Three parallel groove-shaped slots or notches 18, 19, 20 are provided symmetrically to bisecting planes 15' which extend perpendicular to the longitudinal axis 4. The groove-shaped slots 18, 19, 20 are preferably constructed roof-shaped with the roof flanks **18*a*, 18*b*, 19*a*, 19*b*, 20*a*, 20*b* being open toward the longitudinal axis 4. The groove-shaped slots 18, 19, 20** are preferably arranged nested one within the other.

The flanks of the groove-shaped slots 18, 19, 20 subtend with respect to the respective tangential plane 17 tangential to the outer boundary surfaces of the individual block-shaped profiled projections or raised portions 15 in the bisecting plane 15' thereof, and angle $\beta$ of about 20°–40°, preferably of about 30°.

For improving the non-slip characteristics under loads in the sole longitudinal direction, the box-shaped profiled projections or raised portions 14 have recesses 26 which exert a suction effect on the floor or playing surface.

To advantageously further improve the non-slip characteristics of the tread 1, the outer edges **24*a*, 24*b* of the thread 1 having a radius R is provided with groove-shaped slots or notches 21, 22 in the area of the two foundation strips 12, 13, which slots extend at least approximately perpendicularly to the foundation strips 12, 13. The groove-shaped slots 21, 22 extend at an angle $\alpha$ of about 30°–60°, preferably about 45° with respect to the tread surface 2, and the slots 21, 22 are distributed along the foundation strips 12, 13 so that at each of the block-shaped profiled projections or raised portions 15, at least two groove-shaped slots 21, 22** are provided.

As shown in FIG. 1, the groove-shaped slots are disposed over or in the area of one of the roof flanks of the groove-shaped slots 18, 19, 20, with the groove-shaped slots 22 being disposed over or in the area of the other roof flank of the respective projections or raised portions 15. The maximum depth T (FIG. 2) of the groove-shaped slots or notches 21, 22 is about 1–4 mm and preferably is about 2 mm.

The uniform distribution of the groove-shaped slots or notches 21, 22 along the foundation strips 12, 13 of the tread 1 subdivide the outer edges **24*a*, 24*b* into a plurality of substantially equal wide rim foundations 23 which effect a type of claw action to increase the traction of the tread 1 travelling along a flat surface such as, for example, a floor of a gymnasium or other playing surface, by a rolling motion through the outer rims 24*a*, 24*b* of the foundation strips 12, 13. By virtue of claw action and rolling motion, the traction is improved at any point along the foundation strips 12, 13 of the tread 1. Moreover, the groove-shaped slots or notches 21, 22 improve the resiliency of the outer rims 24*a*, 24*b* of the tread 1 and enhance the close adaptability of the tread 1** to the respective contour or configuration of the floor or surface approximately in the manner of an articulated edge of a ski.

To further increase the traction effect, the individual rim foundations 23 may either be roughened or provided with a profiled regular or profiled irregular surface. Additionally, it is possible to incorporate into the rim foundations 23 an organic, inorganic, preferably ceramic or metallic splinter material of an irregular structure to increase the adhesion between the sole and the ground or playing surface.

An especially elastic, soft step for the sport shoe is ensured in the middle tread zone 8 by providing a certain overlapping of the nub-shaped projections or raised portions 9 which may be constructed with a round profile or shape or an oblong or elongated profile or shape extending outwardly of the tread surface 2 and forming the remaining parts of the sole. As shown in FIG. 1, the elongated projections 9 extend substantially transversely of the longitudinal axis 4 of the outer sole.

While we have shown and described only one embodiment in accordance with the present invention, it is understood that the same is not limited thereto, but is susceptible of numerous changes and modifications as known to those skilled in the art, and we therefor do not wish to be limited to the details shown and described herein, but intend to cover all such changes and modifications as are encompassed by the scope of the appended claims.

We claim:

1. A profiled outer sole for shoes made of a material having rubber-elastic properties, the sole including a tread surface, the tread surface comprises a front tread end portion and a rear tread end portion each having a predetermined profile, a middle area provided with a plurality of profiled projections arranged approximately symmetrically with respect to a longitudinal axis of the tread surface, and a profiled marginal area arranged on respective sides of the middle area, characterized in that the front tread end portion, the rear tread end portion and each of the middle and marginal areas include outer edges adjoining the tread surface to a shell rim of the outer sole, each of the outer edges is rounded with a predetermined radius, and in that a plurality of groove-shaped slots are substantially uniformly distributed along outer edges of each of the marginal areas, each of said last-mentioned groove-shaped slots extending at least approximately perpendicularly to the respective outer edge.

2. An outer sole according to claim 1, characterized in that the outer sole is a molded sole.

3. An outer sole according to claim 1, characterized in that the outer sole is a sports shoe outer sole.

4. An outer sole according to claim 1, characterized in that the outer sole is made from a material selected from the group consisting of rubber and synthetic resinous material.

5. An outer sole according to claim 1, characterized in that the front tread end portion and rear tread end portion each has a fine profiling, the fine profiling is constructed as a strip-shaped profile including a plurality of spaced transverse webs extending outwardly from the outer sole and approximately perpendicularly to the longitudinal axis of the tread surface.

6. An outer sole according to claim 1, characterized in that the profiled marginal areas each include a coarse profiling, and in that each marginal area is formed as a continuous foundation strip.

7. An outer sole according to claim 1, characterized in that the profiled marginal areas each include a coarse profiling, and in that each marginal area is formed of a plurality of individual foundation strips.

8. An outer sole according to claim 6, characterized in that each foundation strip is formed by a plurality of spaced block-shaped profiled projections with adjacent projections enclosing box-shaped profiled projections.

9. A profiled outer sole for shoes made of a material having rubber-elastic properties, the sole including a tread surface, the tread surface comprises a front tread end portion and a rear tread end portion each having a predetermined profile, a middle area provided with a plurality of profiled projections arranged approximately symmetrically with respect to a longitudinal axis of the tread surface, and a profiled marginal area arranged on respective sides of the middle area, characterized in that the front tread end portion, the rear tread end portion, and each of the middle and marginal areas include outer edges adjoining the tread surface to a shell rim of the outer sole, each of the outer edges is rounded with a predetermined radius, the profiled marginal areas each include a coarse profiling, each marginal area is formed as a continuous foundation strip, each foundation strip is formed by a plurality of spaced block-shaped profiled projections with adjacent projections enclosing box-shaped profiled projections, and in that each of the block-shaped profiled projections includes a plurality of groove-shaped slots extending parallel to one another.

10. An outer sole according to claim 9, characterized in that the groove-shaped slots are constructed roof-shaped with respective roof flanks opening in a longitudinal direction toward the longitudinal axis of the outer sole.

11. An outer sole according to claim 9, characterized in that the groove-shaped slots are arranged at least approximately symmetrically with respect to a bisecting plane extending through the block-shaped projections and intersecting the longitudinal axis substantially perpendicularly thereto.

12. An outer sole according to claim 11, characterized in that the groove-shaped slots subtend a predetermined angle with a tangential plane arranged at an outer boundary surface of the respective block-shaped profiled projection.

13. An outer sole according to claim 12, characterized in that the predetermined angle lies in the range of about 20°–40°.

14. An outer sole according to claim 12, characterized in that the predetermined angle is about 30°.

15. An outer sole according to claim 8, characterized in that at least one recess means is provided in each of the box-shaped profiled projections for effecting at least partially a suction action.

16. A profiled outer sole for shoes made of a material having rubber-elastic properties, the sole including a tread surface, the tread surface comprises a front tread end portion and a rear tread end portion each having a predetermined profile, a middle area provided with a plurality of profiled projections arranged approximately symmetrically with respect to a longitudinal axis of the tread surface, and a profiled marginal area arranged on respective sides of the middle area, characterized in that the front tread end portion, the rear tread end portion, and each of the middle and marginal areas include outer edges adjoining the tread surface to a shell rim of the outer sole, each of the outer edges is rounded to a predetermined radius, the profiled marginal areas each include a coarse profiling, each marginal area is formed as a continuous foundation strip, each foundation strip is formed by a plurality of spaced block-shaped profiled projections with adjacent projections enclosing box-shaped profiled projections, at least one recess means is provided in each of the box-shaped profiled projections for effecting at least partially a suction action, a plurality of groove-shaped slots are substantially uniformly distributed along each of the foundation strips, and in that each of said last-mentioned groove-shaped slots extends at least approximately perpendicularly to the respective foundation strips.

17. An outer sole according to claim 16, characterized in that said last-mentioned groove-shaped slots have a depth of between 1–4 mm.

18. An outer sole according to claim 16, characterized in that said last-mentioned groove-shaped slots have a depth of about 2 mm.

19. An outer sole according to claim 16, characterized in that adjacent groove-shaped slots in the foundation strips define therebetween individual edge foundations, and in that each of the edge foundations is provided with at least one of a roughened surface and a surface profiling.

20. An outer sole according to claim 19, characterized in that at least one of an organic, inorganic, and splinter material of an irregular structure is arranged in each of the edge foundations.

21. An outer sole according to claim 16, characterized in that each of the foundation strips include between five to ten block-shaped profiled projections arranged approximately in a uniform distribution in a longitudinal direction of the respective foundation strips.

22. An outer sole according to claim 16, characterized in that the last-mentioned groove-shaped slots are arranged at the two foundation strips so as to extend at a predetermined angle of inclination with respect to the tread surface.

23. An outer sole according to claim 22, characterized in that the predetermined angle of inclination lies in the range of about 30° to 60°.

24. An outer sole according to claim 22, characterized in that the predetermined angle of inclination is about 45°.

25. An outer sole according to claim 23, characterized in that said last-mentioned groove-shaped slots have a depth of between 1–4 mm.

26. An outer sole according to claim 23, characterized in that said last-mentioned groove-shaped slots have a depth of about 2 mm.

27. An outer sole according to claim 25, characterized in that adjacent groove-shaped slots in the foundation strips define therebetween individual edge foundations, and in that each of the edge foundations is provided with at least one of a roughened surface and a surface profiling.

28. An outer sole according to claim 27, characterized in that at least one of an organic, inorganic, and splinter material of an irregular structure is arranged in each of the edge foundations.

29. An outer sole according to claim 25, characterized in that each of the foundation strips include between five to ten block-shaped profiled projections arranged approximately in a uniform distribution in a longitudinal direction of the respective foundation strip.

30. An outer sole according to claim 23, characterized in that adjacent groove-shaped slots in the foundation strips define therebetween individual edge foundations, and in that each of the edge foundations is provided with at least one of a roughened surface and surface profiling.

31. An outer sole according to claim 30, characterized in that at least one of an organic, inorganic, and splinter material of an irregular structure is arranged in each of the edge foundations.

32. An outer sole according to claim 23, characterized in that each of the foundation strips include between five to ten block-shaped profiled projections arranged approximately in a uniform distribution in a longitudinal direction of the respective foundation strips.

33. A profiled outer sole for shoes made of a material having rubber-elastic properties, the sole including a tread surface, the tread surface comprises a front tread end portion and a rear tread end portion each having a predetermined profile, a middle area provided with a plurality of profiled projections arranged approximately symmetrically with respect to a longitudinal axis of the tread surface, and a profiled marginal area arranged on respective sides of the middle area, characterized in that the front tread end portion, the rear tread end portion, and each of the middle and marginal areas include outer edges adjoining the tread surface to a shell rim of the outer sole, each of the outer edges is rounded with a predetermined radius, the profiled marginal areas each include a coarse profiling, each marginal area is formed of a plurality of individual foundation strips, a plurality of groove-shaped slots are substantially uniformly distributed along each of the foundation strips, and in that each of said last-mentioned groove-shaped slots extends at least approximately perpendicularly to the respective foundation strips.

34. An outer sole according to claim 33, characterized in that adjacent groove-shaped slots in the foundation strips define therebetween individual edge foundations, and in that each of the edge foundations is provided with at least one of a roughened surface and a surface profiling.

35. An outer sole according to claim 34, characterized in that at least one of an organic, inorganic, and splinter material of an irregular structure is arranged in each of the edge foundations.

36. An outer sole according to claim 33, characterized in that the last-mentioned groove-shaped slots are arranged at the two foundations strips so as to extend at a predetermined angle of inclination with respect to the tread surface.

37. An outer sole according to claim 36, characterized in that adjacent groove-shaped slots in the foundation strips define therebetween individual edge foundations, and in that each of the edge foundations is provided with at least one of a roughened surface and a surface profiling.

38. An outer sole according to claim 1, characterized in that said last-mentioned groove-shaped slots have a depth of between 1–4 mm.

39. An outer sole according to claim 1, characterized in that said last-mentioned groove-shaped slots have a depth of about 2 mm.

40. An outer sole according to claim 1, characterized in that the last-mentioned groove-shaped slots extend at a predetermined angle of inclination with respect to the tread surface.

41. An outer sole according to claim 40, characterized in that the predetermined angle of inclination lies in the range of about 30° to 60°.

42. An outer sole according to claim 40, characterized in that the predetermined angle of inclination is about 45°.

43. An outer sole according to claim 40, characterized in that said last-mentioned groove-shaped slots have a depth of between 1–4 mm.

44. An outer sole according to claim 40, characterized in that said last-mentioned groove-shaped slots have a depth of about 2 mm.

45. An outer sole according to claim 1, characterized in that adjacent groove-shaped slots in the foundation strips define therebetween individual edge foundations, and in that each of the edge foundations is provided with at least one of a roughened surface and a surface profiling.

46. An outer sole according to claim 45, characterized in that at least one of an organic, inorganic, and splinter material of an irregular structure is arranged in each of the edge foundations.

47. A profiled outer sole for shoes made of a material having rubber-elastic properties, the sole including a tread surface, the tread surface comprises a front tread end portion and a rear tread end portion each having a predetermined profile, a middle area provided with a plurality of profiled projections arranged approximately symmetrically with respect to a longitudinal axis of the tread surface, and a profiled marginal area arranged on respective sides of the middle area, characterized in that the front tread end portion, the rear trend end portion, and each of the middle and marginal areas include outer edges adjoining the tread surface to a shell rim of the outer sole, each of the outer edges is rounded with a predetermined radius, and in that each of the marginal areas includes a plurality of block-shaped profiled projections having groove-shaped slots extending parallel to one another.

48. An outer sole according to claim 47, characterized in that each marginal area includes between five to ten block-shaped profiled projections.

49. An outer sole according to claim 48, characterized in that box-shaped profiled projections are arranged between adjacent block-shaped profiled projections.

50. An outer sole according to claim 49, characterized in that at least one recess means is provided in each of the box-shaped profiled projections for effecting at least partially a suction action.

51. An outer sole according to claim 1, characterized in that the predetermined radius is about 3–8 mm.

52. An outer sole according to claim 1, characterized in that the predetermined radius is about 5 mm.

53. An outer sole according to claim 1, characterized in that at least some of the plurality of profiled projections provided in the middle area have an elongated shape and extend substantially transversely of the longitudinal axis of the outer sole.

54. An outer sole according to claim 53, characterized in that adjacent elongated profiled projections in the middle area are arranged in an overlapping relationship.

55. An outer sole according to claim 54, wherein at least some of the plurality of profiled projections have one of a circular and semi-circular cross-sectional configuration.

56. An outer sole according to claim 1, characterized in that each marginal area is formed as a continuous foundation strip, each foundation strip including a plurality of spaced block-shaped profiled projections, and in that said groove-shaped slots are arranged at the two foundation strips so as to extend at a predetermined angle of inclination with respect to the tread surface.

57. An outer sole according to claim 56, characterized in that each of the foundation strips further includes box-shaped profiled projections arranged between adjacent block-shaped profiled projections.

58. An outer sole according to claim 57, characterized in that each of the block-shaped profiled projections includes a plurality of groove-shaped slots extending across the profiled projections and subtending a predetermined angle with a tangential plane arranged at an outer boundary surface of the respective block-shaped profiled projections.

59. An outer sole according to claim 58, characterized in that at least one recess means is provided in each of the box-shaped profiled projections for effecting at least partially a suction action.

60. An outer sole according to claim 59, characterized in that adjacent groove-shaped slots in the foundation strips define therebetween individual edge foundations, and in that each of the edge foundations is provided with at least one of a roughened surface and a surface profiling.

61. An outer sole according to claim 60, characterized in that at least one of an organic, inorganic, and splinter material of an irregular structure is arranged in each of the edge foundations.

62. An outer sole according to claim 1, characterized in that a plurality of spaced block-shaped profiled projections are provided in each of the marginal areas, each marginal area is formed of a plurality of individual foundation strips, and in that said groove-shaped slots are arranged in each of the marginal areas so as to extend at a predetermined angle of inclination with respect to the tread surface.

63. An outer sole according to claim 62 characterized in that box-shaped profiled projections are arranged between adjacent block-shaped profiled projections.

64. An outer sole according to claim 63, characterized in that each of the block-shaped profiled projections includes a plurality of groove-shaped slots extending across the profiled projection and subtending a predetermined angle with a tangential plane arranged at an outer boundary surface of the respective block-shaped profiled projections.

65. An outer sole according to claim 64, characterized in that at least one recess means is provided in each of the box-shaped profiled projections for effecting at least partially a suction action.

66. An outer sole according to claim 64, characterized in that adjacent groove-shaped slots in the marginal areas define therebetween individual edge foundations, and in that each of the edge foundations is provided with at least one of a roughened surface and a surface profiling.

67. An outer sole according to claim 66, characterized in that at least one of an organic, inorganic, and splinter material of an irregular structure is arranged in each of the edge foundations.

* * * * *